US008534811B2

(12) United States Patent
Kobayashi et al.

(10) Patent No.: US 8,534,811 B2
(45) Date of Patent: Sep. 17, 2013

(54) INK SUPPLY DEVICE SUPPLYING INK TO RECORDING HEAD

(71) Applicant: Brother Kogyo Kabushiki Kaisha, Aichi-Ken (JP)

(72) Inventors: Akihito Kobayashi, Nagoya (JP); Hirotake Nakamura, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/625,175

(22) Filed: Sep. 24, 2012

(65) Prior Publication Data

US 2013/0162728 A1 Jun. 27, 2013

(51) Int. Cl.
*B41J 2/175* (2006.01)

(52) U.S. Cl.
USPC ..... 347/85

(58) Field of Classification Search
USPC ..... 347/84, 85
See application file for complete search history.

(56) References Cited

U.S. PATENT DOCUMENTS

| | | | | |
|---|---|---|---|---|
| 5,043,746 | A * | 8/1991 | Abe | 347/85 |
| 6,068,370 | A | 5/2000 | Miller et al. | |
| 6,247,802 | B1 * | 6/2001 | Gasso | 347/85 |
| 6,755,514 | B2 * | 6/2004 | Koga | 347/85 |
| 7,537,322 | B2 * | 5/2009 | Ishikawa et al. | 347/85 |
| 8,226,220 | B2 * | 7/2012 | Nukui | 347/85 |

FOREIGN PATENT DOCUMENTS

JP 2007-144905 6/2007

* cited by examiner

*Primary Examiner* — Anh T. N. Vo
(74) *Attorney, Agent, or Firm* — Frommer Lawrence & Haug LLP

(57) ABSTRACT

A plurality of tubes each corresponds to each of a plurality of connection ports and each has one end connected to a storage portion and the other end connected to the corresponding connection port. Ink is configured to be supplied from the storage portion to a flow channel member through the plurality of tubes. Each of the plurality of tubes has a first portion adjacent to the other end and a second portion adjacent to the first portion. The first portion is positioned between the other end and the second portion. A tube retaining member is provided on the carriage and includes a first retaining portion configured to retain the first portions to be arranged in a second direction, and a second retaining portion configured to retain the second portions to be arranged in a third direction intersecting with an imaginary plane.

8 Claims, 9 Drawing Sheets

INK SUPPLY DEVICE SUPPLYING INK TO RECORDING HEAD

CROSS REFERENCE TO RELATED APPLICATION

This application claims priority from Japanese Patent Application No. 2011-284298 filed Dec. 26, 2011. The entire content of the priority application is incorporated herein by reference.

TECHNICAL FIELD

The present invention relates to an ink supply device that supplies ink from an ink tank storing the ink to a recording head mounted on a carriage through a tube.

BACKGROUND

As an example of the above ink supply device, there is known an ink-jet image recording apparatus that ejects ink based on an input signal to record an image onto a recording medium such as a recording sheet. The ink-jet image recording apparatus ejects ink supplied to a recording head from a nozzle to thereby record an image on the recording medium.

The recording head is mounted on a carriage and is made to reciprocate in a certain direction with respect to the recording medium. The carriage receives a driving force from a drive source such as a motor to reciprocate in a certain direction while being guided by a guide shaft or a guide tail. During the reciprocating motion of the carriage, ink droplets are selectively ejected from the recording head onto the recording medium. As a result, an image is recorded by the ink droplets landed onto the recording medium.

The ink to be used in the image recording is supplied from an ink tank provided in an ink cartridge so as to store the ink to the recording head mounted on the carriage through a channel member provided in the carriage and is ejected from the recording head. The channel member is a member constituting an ink channel. The channel member is resin-molded.

There is a method using a tube as a method of supplying the ink from the ink tank to the recording head. The tube serves as a channel for flowing the ink from the ink tank to the recording head (more specifically, a channel member) and is flexible enough to follow the reciprocating motion of the carriage. The tube has a length enough to connect the carriage and ink tank even when the carriage is moved to a position farthest from the ink tank. Thus, when the carriage is moved close to the ink tank, the tube is bent.

If an ink-jet image recoding apparatus has a function of recording a color image onto a recording medium, the ink tank and tube are each provided in plural. More specifically, the ink tank and tube are each provided for each of inks of colors (cyan (C), magenta (M), yellow (Y), and black (Bk)).

The plurality of tubes is arranged side-by-side. In a case where the tubes are arranged in a lateral direction (e.g., horizontal direction), a load to be applied when the tubes are bent varies among the tubes. This may cause the carriage connected to the tube to rattle. Further, the tubes are rubbed with each other during movement of the carriage, which may cause noise.

On the other hand, in a case where the tubes are arranged in a vertical direction (e.g., direction of gravitational force), if the ink leaks from a connection between the tube and channel member, the ink that has leaked from the connection of an upper tube may be adhered to the connection of a lower tube.

In this state, when the connection of the lower tube and a sub-tank is released for maintenance and the connection thereof is made once again, the ink of the upper tube may go into the lower tube.

The arrangement of the plurality of tubes in the vertical direction is unfavorable for the following reason. In an ink-jet image recording apparatus, the channel member is provided with a damper unit for absorbing dynamic pressure caused by the reciprocating motion of the carriage. The damper unit is designed to be able to increase/decrease a volume of the channel member so as to absorb the dynamic pressure. For example, the damper unit is a film constituting one surface of the channel member. In this configuration, in the case where the plurality of tubes are arranged in the horizontal direction, the above-mentioned film can be shared between the inks of respective colors since a plurality of nozzles formed in the recording head are also arranged in the horizontal direction. That is, the film needs to be provided for only one surface of the ink channels of respective colors formed in the channel member. However, in the case where the plurality of tubes are arranged in the vertical direction, arrangement direction of the channels of the inks of respective colors inside the channel member needs to be changed from the vertical direction to horizontal direction. This complicates a configuration of the ink channels of respective colors inside the channel member, with the result that the film needs to be provided for two or more surfaces, for example, for each color.

To solve the above-described problem, a plurality of tubes is arranged in the vertical direction at a bent portion thereof and changed in arrangement direction at the carriage from the vertical direction to horizontal direction to be connected to connection ports provided in the carriage.

SUMMARY

However, the plurality of tubes is changed in arrangement direction at the carriage from the vertical direction to horizontal direction. In other words, the plurality of tubes is twisted at the carriage. The twisting applies unnecessary load to the tubes. As a result, the carriage connected to the tubes may be displaced or tilted by the load.

The present invention has been made in view of the above situation, and an object thereof is to provide an ink supply device capable of reducing a load to be applied to the plurality of tubes connected to the carriage.

In order to attain the above and other objects, there is provided an ink supply device including a storage portion configured to store ink, a carriage configured to be moved in a first direction, a recording head, a flow channel member, a plurality of tubes, and a tube retaining member. The recording head is mounted on the carriage and including nozzles that allow ink droplets to be ejected. The flow channel member is mounted on the carriage and includes a plurality of connection ports arranged in a second direction. The first direction and the second direction lay in an imaginary plane which is parallel to a recording sheet. The flow channel member includes a flow channel that allows the ink to flow from the plurality of connection ports to the recording head. The plurality of tubes each corresponds to each of the plurality of connection ports and each has one end and the other end. The one end is connected to the storage portion. The other end is connected to the corresponding connection port. The ink is configured to be supplied from the storage portion to the flow channel member through the plurality of tubes. Each of the plurality of tubes has a first portion adjacent to the other end and a second portion adjacent to the first portion. The first portion is positioned between the other end and the second portion. The tube retaining member is provided on the carriage and includes a first retaining portion configured to retain the first portions to be arranged in the second direction, and a second retaining portion configured to retain the second portions to be arranged in a third direction intersecting with the imaginary plane.

DETAILED DESCRIPTION

Next, an embodiment of the present invention will be described with reference to the accompanying drawings. It should be noted that the embodiment described below is merely illustrative of this invention and that appropriate changes and modifications may be made without departing from the spirit of this invention.

Schematic Configuration of Multifunction Apparatus 10

Figure 1:
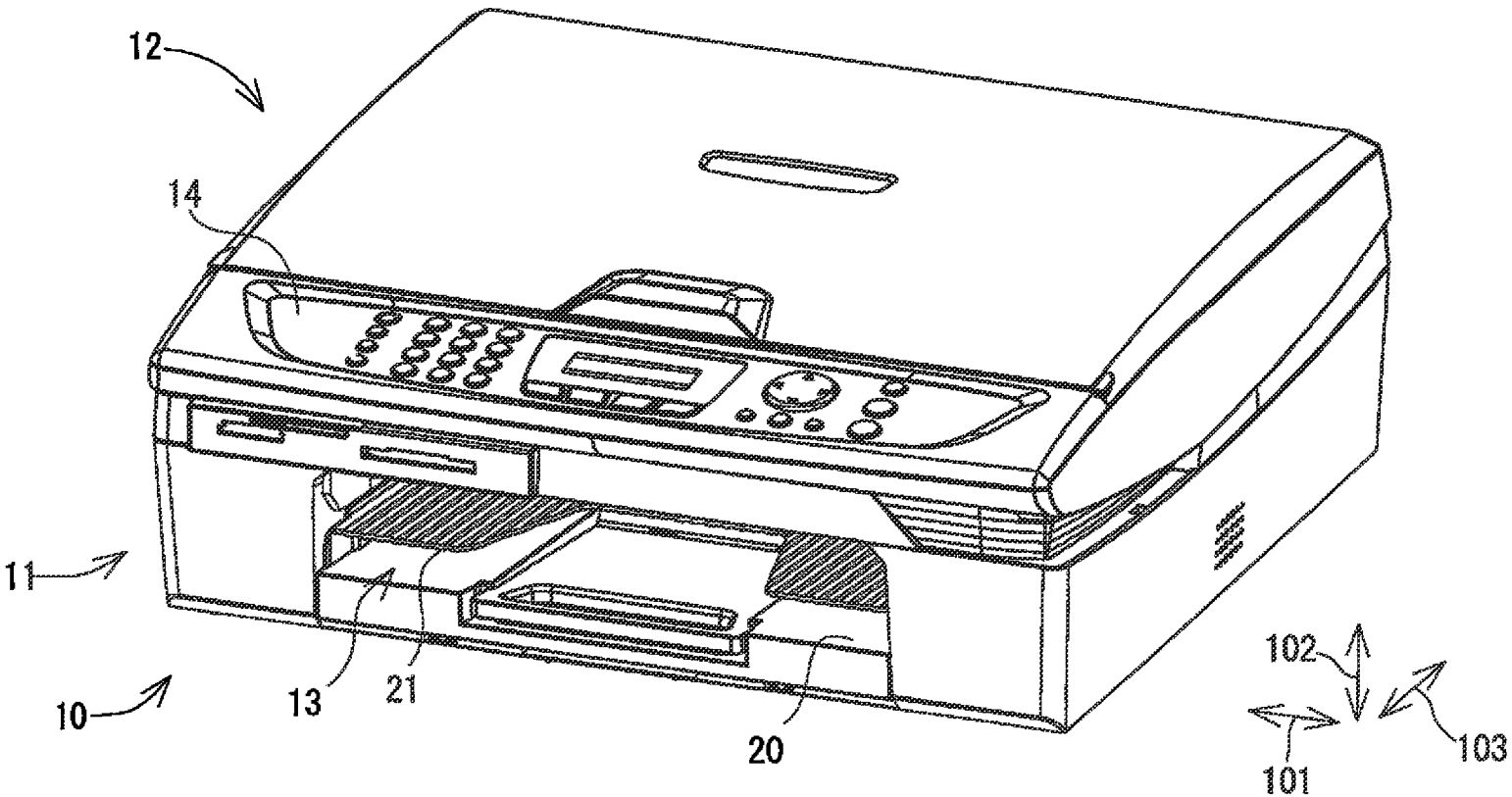
FIG. 1 is a perspective view showing an external configuration of a multifunction apparatus according to an embodiment of the present invention.
Figure 2:
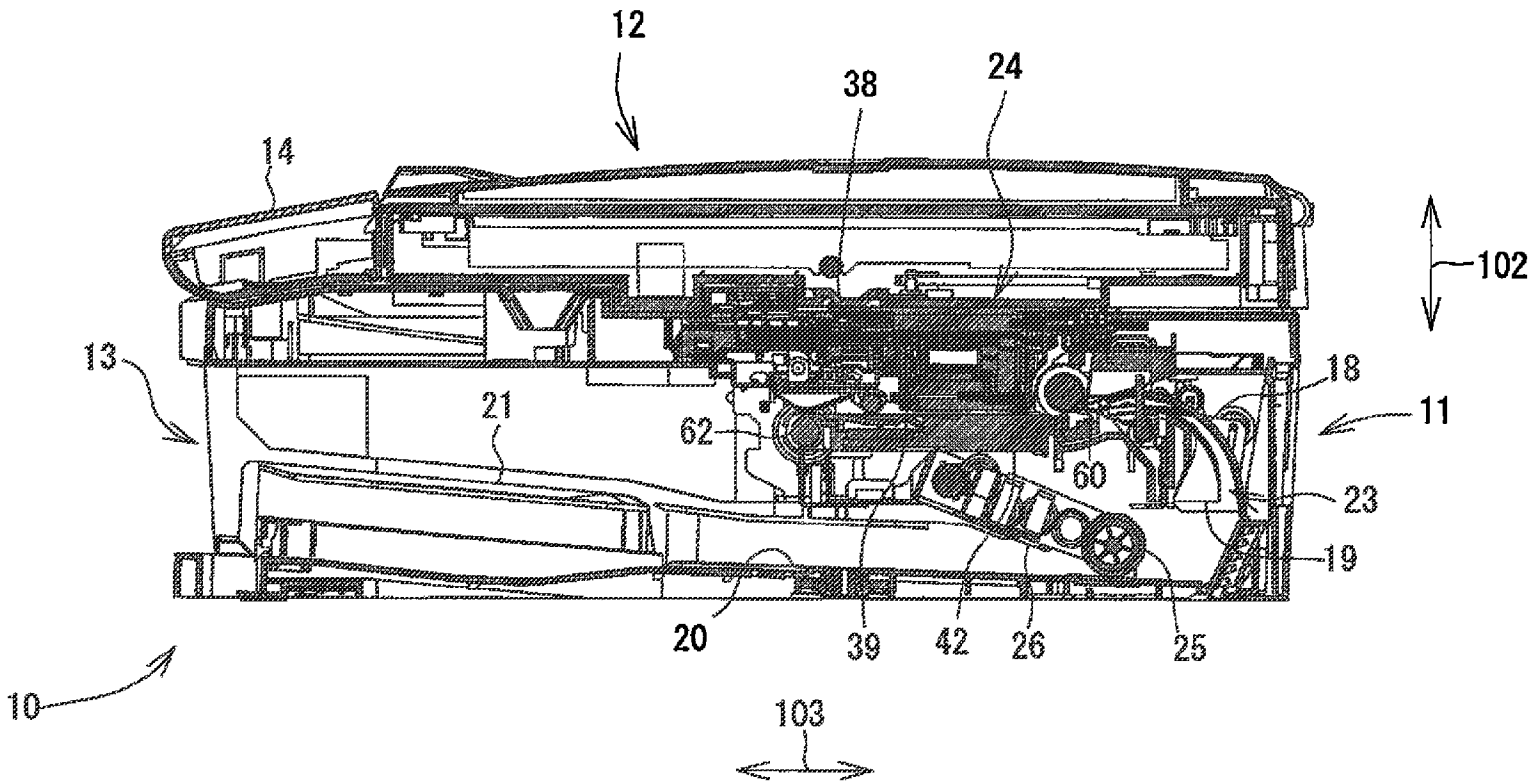
FIG. 2 is a vertical cross sectional view showing an internal configuration of the multifunction apparatus shown in FIG. 1.

As illustrated in FIGS. 1 and 2, a multifunction apparatus 10 integrally includes a printer unit 11 and a scanner unit 12 and has a printer function, a scanner function, a copy function, and a facsimile function. The printer unit 11 is an example of ink supply device.

The printer unit 11 is provided at a lower portion of the multifunction apparatus 10, and the scanner unit 12 is provided at an upper portion thereof. The printer unit 11 is connected to an external information device such as a computer and records an image or a character onto a recording sheet (example of a recording medium) based on print data including image data or document data and transmitted from the external information device. The scanner unit 12 is so-called a flat-bed scanner.

The multifunction apparatus 10 is substantially formed in a rectangular parallelepiped shape having a wide width and a thin thickness. That is, dimensions of the multifunction apparatus 10 in a width direction 101 and a depth direction 103 are larger than a dimension thereof in a height direction 102. The width direction 101 corresponds to a left-right direction, the depth direction 103 to front-rear direction, and the height direction 102 to a vertical direction. The printer unit 11 has an opening 13 formed at the front surface thereof. The opening 13 has therein a sheet tray 20 and a sheet discharge tray 21. A recording sheet accommodated in the sheet tray 20 is fed inside the printer unit 11, and the recording sheet having a desired image formed thereon is discharged to the sheet discharge tray 21.

In the following description, the side of the multifunction apparatus 10 on which the opening 13 is formed (the left side in FIG. 2) will be called the "front side," and the opposite side (the right side in FIG. 1) will be called the "rear side." Further, the left and right sides of the multifunction apparatus 10 will be based on the perspective of a user facing the front side of the multifunction apparatus 10. In other words, the lower right side in FIG. 1 will be the "right side," while the upper left side will be the "left side."

An operation panel 14 is provided at a front upper portion of the multifunction apparatus 10. In the operation panel 14, a predetermined input is performed thereon so as to allow the printer unit 11 and the scanner unit 12 to perform a desired operation. The operation panel 14 is provided with a plurality of buttons for use in input operation or a display for displaying an operating state of the multifunction apparatus 10 or error. When the multifunction apparatus 10 is connected to the external information device, the multifunction apparatus 10 can be operated based on a command transmitted from the external information device via communication software such as a printer driver or a scanner driver.

Printer Unit 11

As illustrated in FIG. 2, the sheet tray 20 is provided at the bottommost portion of the multifunction apparatus 10. The sheet discharge tray 21 is provided above the sheet tray 20. The sheet tray 20 and sheet discharge tray 21 are connected to each other by a sheet conveying path 23 so as to allow the recording sheet to be conveyed from the sheet tray 20 to the sheet discharge tray 21. The recording sheet accommodated in the sheet tray 20 is guided along the sheet conveying path 23 so as to make a U-turn upward from bottom to be conveyed to an image recording unit 24. The recording sheet onto which an image has been recorded by the image recording unit 24 is discharged to the sheet discharge tray 21.

The sheet tray 20 has a vessel shape with an upper side opened. In this sheet tray 20, the recording sheets are accommodated in a stacked state. For example, recording sheets of various sizes up to A3 size (A3 size, A4 size, B5 size, letter size, etc.) can be accommodated in the sheet tray 20.

The sheet discharge tray 21 has a tray shape, and the recording sheet is discharged onto an upper surface of the tray. The sheet discharge tray 21 is disposed closer to the front surface of the printer unit 11 than the sheet tray 20 in the depth direction 103. Thus, in the rear side, the sheet discharge tray 21 does not exist above the sheet tray 20.

A sheet supply roller 25 is provided at the rear side of the sheet tray 20. The sheet supply roller 25 supplies the recording sheets stacked in the sheet tray 20 to the sheet conveying path 23. Driving force is transmitted to the sheet supply roller 25 from a not-illustrated motor to rotate the sheet supply roller 25. The sheet supply roller 25 is rotatably supported to a tip end of a sheet supply arm 26. The sheet supply arm 26 is configured to be able to pivot with a sheet supply roller 25 side set as a tip end side of the pivot. By the pivot, the sheet supply roller 25 moves up and down in such a direction as to close to or separate from the sheet tray 20. The sheet supply arm 26 is biased by a weight of the sheet supply roller 25 or a spring to pivot downward and moves upward in accordance with an amount of the recording sheets accommodated in the sheet tray 20. As a result, the sheet supply roller 25 comes into contact with the recording sheet positioned uppermost in the sheet tray 20. When the sheet supply roller 25 is rotated in such a state, the recording sheet positioned uppermost is sent to the sheet conveying path 23 by a frictional force between a roller surface of the sheet supply roller 25 and the recording sheet.

The sheet conveying path 23 extends upward from the sheet tray 20 at the rear side, curves toward the front side, extends from the rear side to the front side along the depth direction 103, and leads to the sheet discharge tray 21 through the image recording unit 24. A portion of the sheet conveying path 23 other than portions where the image recording unit 24 and the like are provided is defined by an outer guide surface and an inner guide surface that face each other at a predetermined interval. For example, the portion of the sheet conveying path 23 curved at the rear side is defined by an outer guide member 18 and an inner guide member 19 that are fixed to an apparatus frame.

The image recording unit 24 includes a carriage 38, a recording head 39, and a platen 42. The recording head 39 is mounted on the carriage 38. The recording head 39 and the platen 42 are disposed to face each other at a predetermined interval. The detailed structure of the image recording unit 24 will be described later.

On an upstream side relative to the image recording unit 24 in a conveying direction of the recording sheet, a pair of conveying roller 60 and pinch roller are provided. Incidentally, in FIG. 2, the pinch roller is hidden by another member and is not illustrated, but the pinch roller is disposed on a lower side of the conveying roller 60 in a pressure contact state. The driving force is transmitted to the conveying roller 60 from a not-illustrated motor to rotate the conveying roller 60. The conveying roller 60 and the pinch roller sandwich the recording sheet being conveyed through the sheet conveying path 23 to convey the recording sheet onto the platen 42.

A pair of sheet discharge roller 62 and spur are provided on a downstream side relative to the image recording unit 24 in the conveying direction. Incidentally, in FIG. 2, the spur is hidden by another member and is not illustrated, but the spur is disposed on an upper side of the sheet discharge roller 62 in a pressure contact state. The driving force is transmitted to the sheet discharge roller 62 from a not-illustrated motor to rotate the sheet discharge roller 62. The sheet discharge roller 62 and the spur sandwich the recorded recording sheet to transport the recoding sheet to the sheet discharge tray 21.

Image Recording Unit 24

Figure 3:
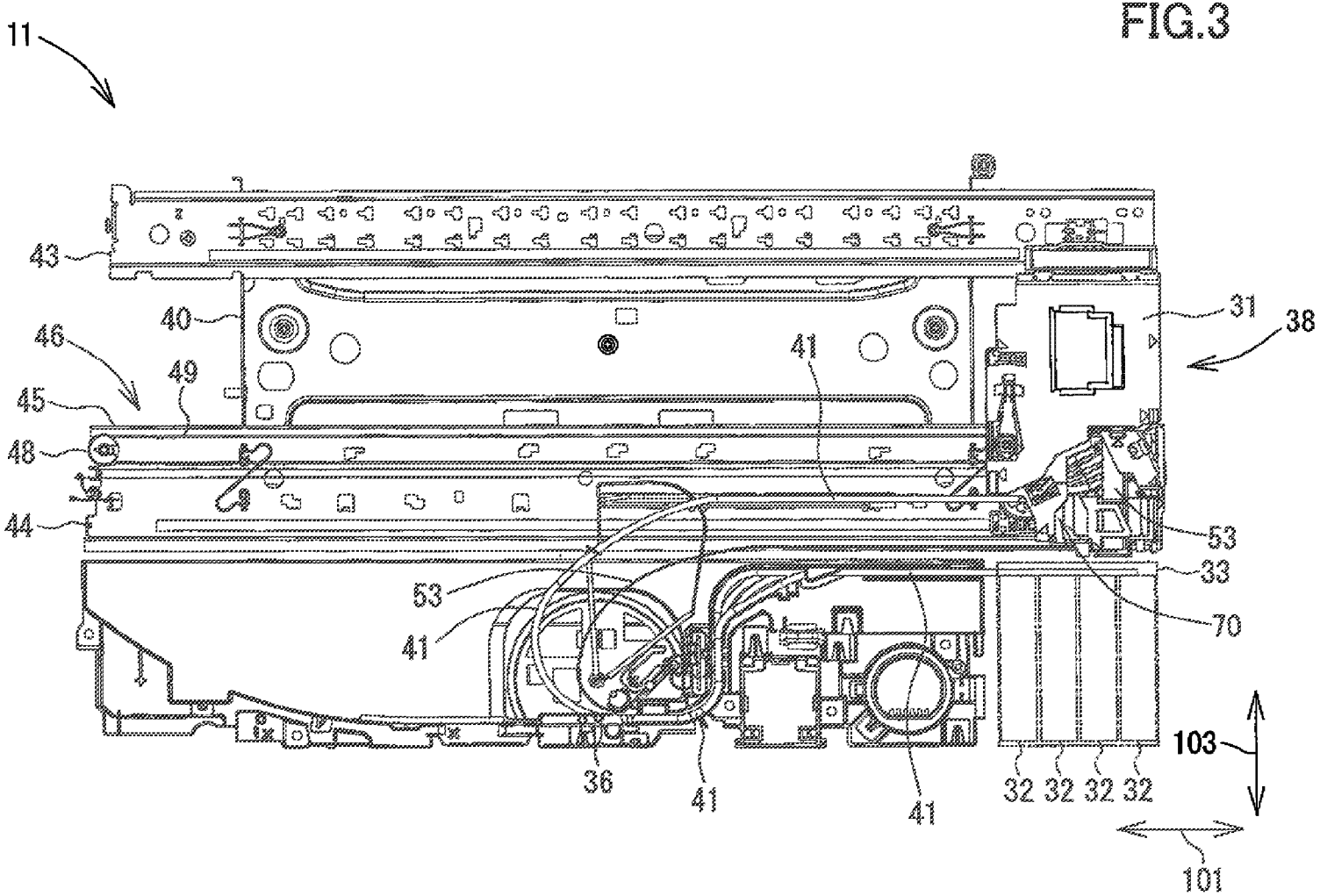
FIG. 3 is a plan view showing an internal configuration of a printer unit shown in FIG. 2.
Figure 4:
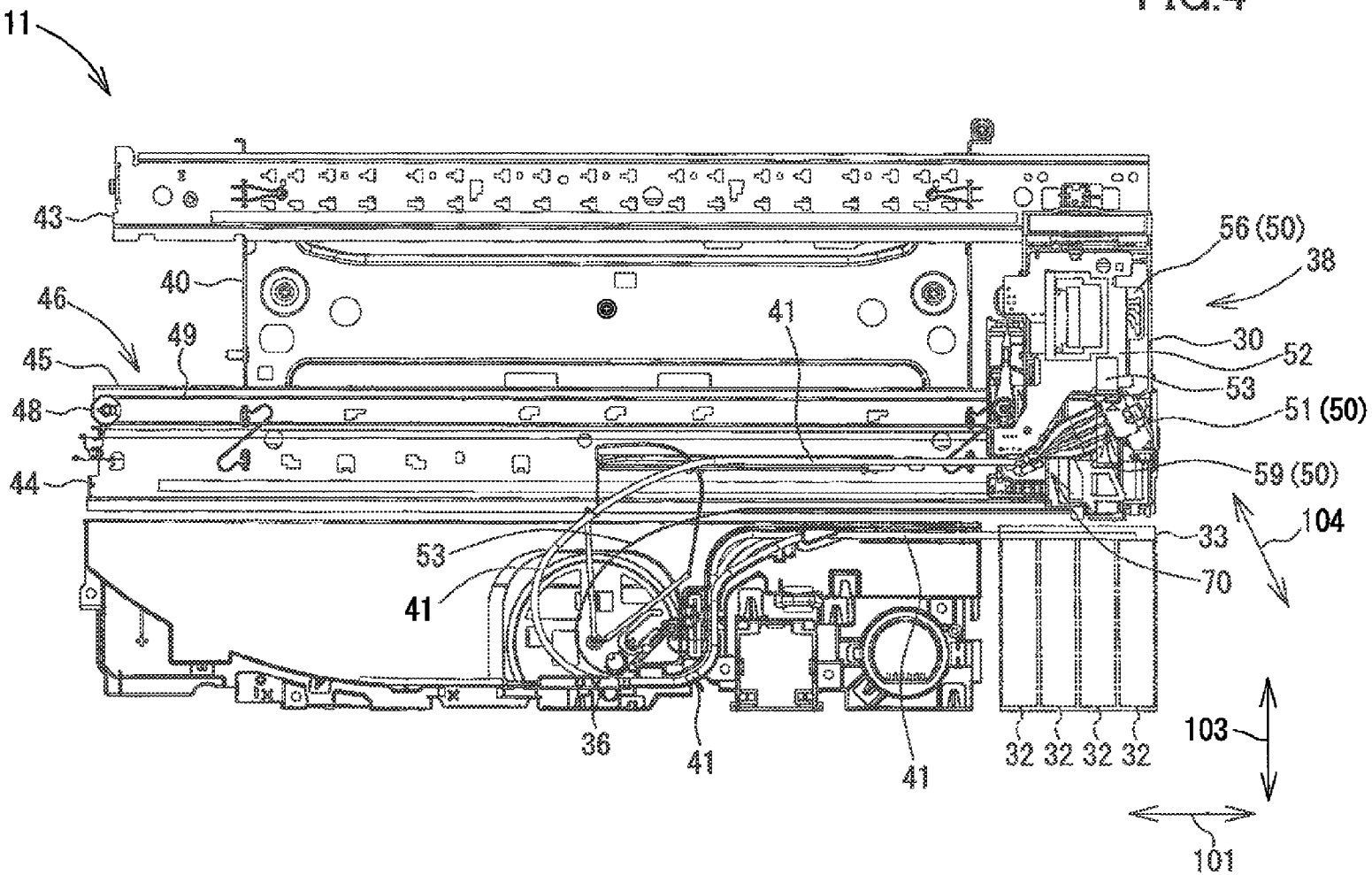
FIG. 4 is a plan view showing an internal configuration of the printer unit without a cover shown in FIG. 3.

As illustrated in FIG. 2, the carriage 38 has the recording head 39 of the ink-jet type mounted thereon. As illustrated in FIGS. 3 and 4, inks of respective colors of cyan (C), magenta (M), yellow (Y) and black (Bk) are supplied to the recording head 39 from the ink tanks of ink cartridges 32 disposed independently of the recording head 39 in the multifunction apparatus 10 through ink tubes 41. In FIGS. 3 and 4, the ink cartridges 32 and a cartridge attachment portion 33 to which the ink cartridges 32 are to be attached are schematically denoted by long dashed short dashed lines, respectively. While the carriage 38 is reciprocating, an image is recorded on the recording sheet conveyed on the platen 42 by selectively ejecting the inks of respective colors onto the recording sheet from nozzles of the recording head 39 as fine ink droplets. The ink cartridges 32 correspond to a storage portion and the ink tubes 41 to tubes.

As illustrated in FIGS. 3 and 4, a pair of guide rails 43 and 44 is provided so as to extend in the left-right direction (i.e., the width direction 101) intersecting with the conveying direction of the recording sheet and provided on an upper side of the sheet conveying path 23. The pair of guide rails 43 and 44 is separated from each other at a predetermined distance in the conveying direction (in a direction from an upper side to a lower side in FIGS. 3 and 4 corresponding to a fifth direction) of the recording sheet. The guide rails 43 and 44 are provided in a casing of the printer unit 11, and constitute a part of a frame supporting respective members constituting the printer unit 11. The carriage 38 is placed to straddle the guide rails 43 and 44 and can slide in an extending direction (the left-right direction in FIG. 3, i.e., the width direction 101) of the guide rails 43 and 44. The width direction 101 corresponds to a first direction.

An edge portion 45 of the guide rail 44 on an upstream side in the conveying direction is bent upward substantially perpendicularly. The carriage 38 is slidably supported on the guide rails 43 and 44 with a sandwiching member, such as a pair of rollers, sandwiching the edge portion 45. Thus, the carriage 38 is positioned with respect to the conveying direction (the direction from the upper side to the lower side in FIG. 3, i.e., the depth direction 103) of the recording sheet, and is slidable in the direction intersecting (perpendicular to, in this embodiment) with the conveying direction of the recording sheet. That is, the carriage 38 is slidably supported on the guide rails 43 and 44 and reciprocates in the direction intersecting with the conveying direction of the recording sheet based on the edge portion 45 of the guide rail 44.

A belt drive mechanism 46 is provided on an upper surface of the guide rail 44. The belt drive mechanism 46 has a drive pulley and a driven pulley 48 that are provided in the vicinities of both ends of the sheet conveying path 23 in the width direction 101 respectively and an endless annular timing belt 49 that is stretched between the drive pulley and the driven pulley 48 and has teeth provided on an inner surface thereof. In FIGS. 3 and 4, the drive pulley is hidden by a lower side of the carriage 38 and is not illustrated, but the drive pulley is disposed on a right end of the sheet conveying path 23 in the width direction 101. A driving force is input to a shaft of the drive pulley from a not-illustrated motor. By rotation of the drive pulley, the timing belt 49 circularly moves around the drive pulley and the driven pulley 48.

Although not illustrated in FIGS. 3 and 4, the carriage 38 is coupled to the timing belt 49 on a bottom surface side of the carriage 38. When the timing belt 49 circularly moves around the drive pulley and the driven pulley 48, the carriage 38 is reciprocated on the guide rails 43 and 44 on the basis of the edge portion 45 as a reference. The recording head 39 mounted on the carriage 38 is also reciprocated in the width direction 101 of the sheet conveying path 23 together with the carriage 38. The recording head 39 mounted on the carriage 38 and the ink cartridges 32 are arranged in the depth direction 103 when the carriage 38 is located at a position closest to the ink cartridges 32.

On a lower side of the sheet conveying path 23, as illustrated in FIG. 2, the platen 42 is provided to face the recording head 39. Incidentally, in FIGS. 3 and 4, the platen 42 is omitted, so that a frame 40 that supports the platen 42 from a lower side is illustrated. The platen 42 is provided to overlap a center portion through which the recording sheet passes within a range where the carriage 38 is reciprocated. A width of the platen 42 is sufficiently wider than a maximum width of the recording sheet usable in the printer unit 11. The recording sheet is supported on an upper surface of the platen 42 so that a distance to the recording head 39 is maintained constantly. The ink droplets ejected from the recording head 39 land on the recording sheet.

A surface of the recording sheet onto which an image is to be recorded extends in the width direction 101 and depth direction 103 in a state where the recording sheet is supported by the platen 42. That is, the carriage 38 reciprocated in the width direction 101 moves along the recording surface of the recording sheet.

Ink Tube 41

As illustrated in FIGS. 3 and 4, the ink cartridges 32 in which the inks of respective colors are stored respectively are attached to the cartridge attachment portion 33 of the printer unit 11.

The four ink tubes 41 corresponding to the respective color inks extend from the cartridge attachment portion 33 to the carriage 38. The ink tubes 41 extending to the carriage 38 supply the respective color inks to the recording head 39 mounted on the carriage 38. That is, the respective color inks to be supplied from the ink cartridges 32 to the recording head 39 are distributed in the respective ink tubes 41. The whole of the ink tubes 41 is located at an ink cartridge side with respect to the one connection port 59 in the depth direction 103. The one connection port 59 is located at a position closest to the recording head 39.

Figure 8:
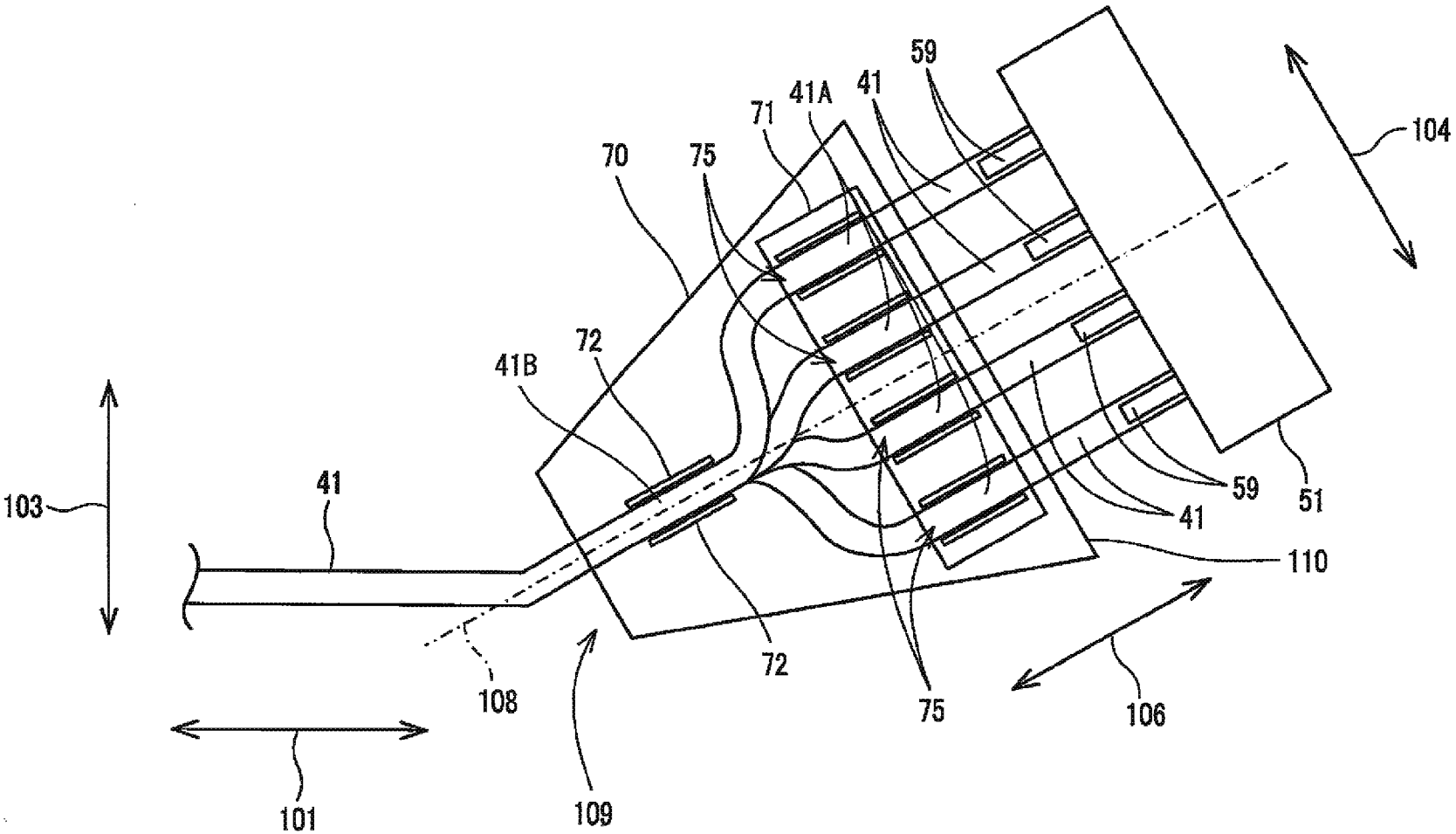
FIG. 8 is a schematic view of ink tubes located on the joint and the tube retaining member.

As illustrated in FIG. 3, one ends of the respective ink tubes 41 are connected to the cartridge attachment portion 33. The ink tubes 41 extending along the width direction 101 from the cartridge attachment portion 33 are bent toward the front side and fixed to a clip 36 at the front side. Then, the ink tubes 41 are bent toward the rear side from the portion at which the ink tubes 41 are fixed to the clip 36 to the carriage 38 when the carriage 38 is located at a position closest to the ink cartridges 32. More specifically, the ink tubes 41 are bent so as to make a U-turn toward the rear side as viewed from above. The bent ink tubes 41 extend in the width direction 101 and connected to the carriage 38. More specifically, the ink tubes 41 are connected, at the other ends thereof, to respective connection portions 59 to be described later. The ink tubes 41 each have flexibility. Thus, the ink tubes 41 are bent following the reciprocation motion of the carriage 38 between the portion at which the ink tubes 41 are fixed to the clip 36 and the carriage 38, and postures of the ink tubes 41 are changed. As illustrated in FIG. 8, each ink tube 41 has a first portion 41A adjacent the other end and a second portion 41B adjacent to the first portion 41A. The first portion 41A is positioned between the other end and the second portion 41B.

The four ink tubes 41 are bundled so as to be arranged along the height direction 102 between the cartridge attachment portion 33 and a portion short of the carriage 38. Inside of the carriage 38, the four ink tubes 41 are twisted at 90° from a state of being arranged along the height direction 102 to a state being arranged along a horizontal direction. The twisted four ink tubes 41 are connected to the connection portions 59, respectively. The twisted state of the four ink tubes 41 is retained in a tube retaining member 70 to be described later.

In this embodiment, the four ink tubes 41 have the same shape. More specifically, the four ink tubes 41 each have a circular cross-section, and the four ink tubes 41 have the same inner and outer diameters. As a matter of course, an embodiment in which the shapes of the four ink tubes are not the same may be adopted. Lengths of the four ink tubes 41 may be the same or different but preferably the same. Although the number of ink tubes 41 are four in this embodiment, the number of ink tubes 41 to be laid may be changed (e.g., six) in accordance with the number of ink colors.

Carriage 38

The carriage 38 has a carriage body 30 (see FIGS. 5 and 6) and a cover 31 (see FIG. 3). The carriage body 30 supports the recording head 39 (see FIG. 2), a flow channel member 50 (see FIGS. 4 and 7), a head control board 52 (see FIG. 4), and the tube retaining member 70 (see FIGS. 5, 6 and 8).

The carriage body 30 has a substantially rectangular parallelepiped shape with an upper side opened. The cover 31 is assembled to cover the opening of the carriage body 30. The recording head 39, the flow channel member 50, the head control board 52, and the tube retaining member 70 are accommodated in an inner space of the carriage body 30. In the following description, a direction referred to merely as "upper side" or "lower side" is defined on the assumption that gravity is applied downward.

The recording head 39 is disposed at a bottom portion of the carriage body 30. A nozzle surface, which is a lower surface of the recording head 39, is exposed to a lower side of the carriage body 30. This allows the ink droplets to be ejected from the nozzles toward the platen 42.

Flow Channel Member 50

In the carriage body 30, the flow channel member 50 is disposed above the recording head 39. The flow channel member 50 has mainly a flow channel portion 55 (see FIG. 7) formed with flow channel, a tank portion 56 (see FIG. 7) storing the inks therein, and a joint 51 (see FIG. 6) to be connected to the ink tubes 41.

The flow channel portion 55 has a thin flat plate shape. In the flow channel portion 55, four inlet ports 57 into which the respective color inks are injected are aligned in line. The inlet ports 57 are each formed in the flow channel portion 55 to have an upper side thereof opened. Further, the respective inlet ports 57 are arranged along a first arrangement direction 104.

Figure 6:
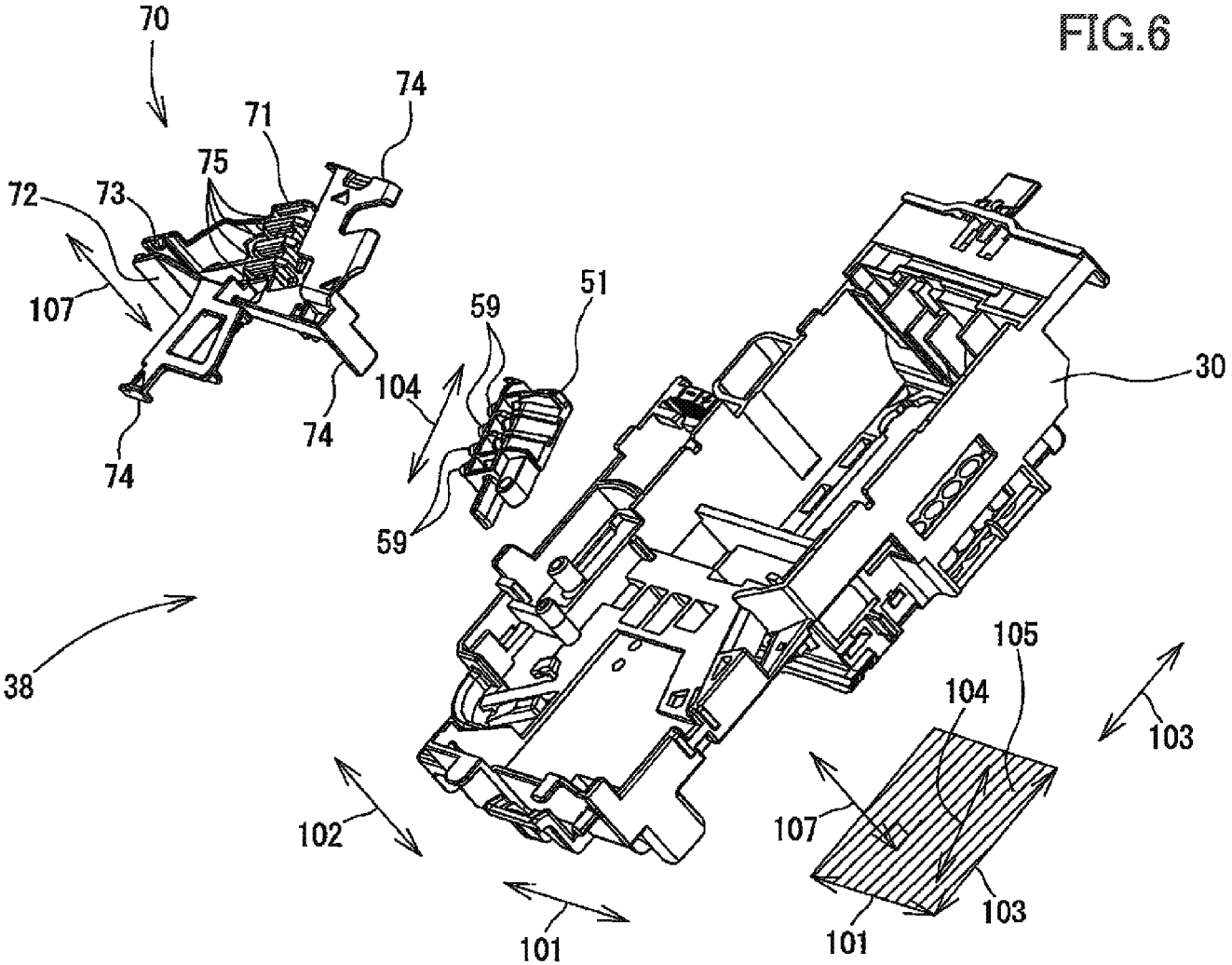
FIG. 6 is an exploded perspective view showing the carriage body, the tube retaining member, and a joint in the carriage.

As illustrated in FIG. 6, the first arrangement direction 104 is oblique with respect to the width direction 101 and depth direction 103. That is, in this embodiment, the first arrangement direction 104 intersects with the width direction 101. Further, the first arrangement direction 104 is parallel to a virtual plane 105 parallel to a plane extending in the width direction 101 and depth direction 103, i.e., the recording surface of the recording sheet. In this embodiment, an angle of an extending direction 106 perpendicular to the first arrangement direction 104 with respect to the width direction 101 is 25°.

The first arrangement direction 104 is not limited to the direction illustrated in FIG. 6 as long as the first arrangement direction 104 is parallel to the virtual plane 105. For example, the angle of the extending direction 106 with respect to the width direction 101 may be an angle different from that illustrated in FIG. 6. Further, the first arrangement direction 104 need not intersect with the width direction 101. That is, the first arrangement direction 104 may be parallel to the width direction 101. In this case, the angle of the extending direction 106 with respect to the width direction 101 is 90°. It is preferred, however, that the angle of the extending direction 106 with respect to the width direction 101 is $0° < \theta \leqq 45°$. The first arrangement direction 104 corresponds to a second direction.

Figure 7:
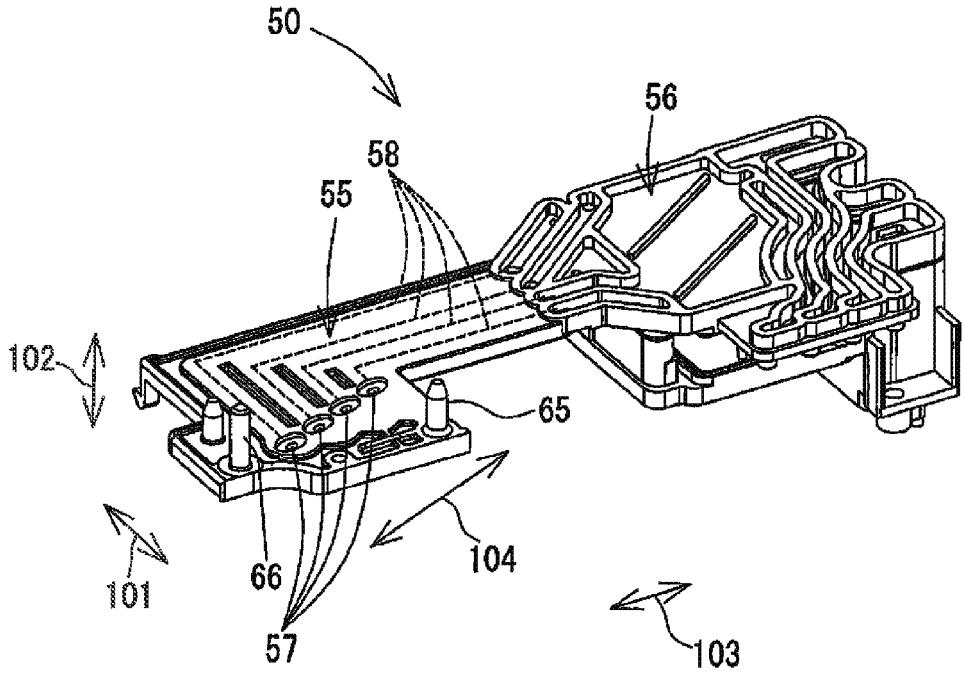
FIG. 7 is a perspective view showing a schematic configuration of a flow channel member.

As denoted by dashed lines in FIG. 7, in the flow channel portion 55, four channels 58 are formed corresponding to the respective inlet ports 57. The channels 58 extend from the respective inlet ports 57 in the width direction 101 to be bent perpendicularly and extend toward the tank portion 56 in the depth direction 103.

In the flow channel member 50, one surface (upper surface, in FIG. 7) of the flow channel portion 55 is opened, and a film is welded to the opening. Forming the upper surface of the flow channel portion 55 with a sheet-like film allows the entire volume of the channels 58 to be increased/decreased. As a result, the flow channel member 50 provided with the film functions as a damper for absorbing dynamic pressure caused by the reciprocating motion of the carriage 38.

The tank portion 56 is partitioned into four chambers corresponding to the four channels 58. The color inks can be independently stored in the chambers respectively. The inks can flow into the chambers from the channels 58 respectively. Further, although not illustrated, the respective chambers of the tank portion 56 are coupled to the recording head 39 so as to enable the respective color inks to flow, and the inks discharged from the respective chambers of the tank portion 56 flow into the recording head 39. Thus, the flow channel member 50 forms the ink channels between the inlet ports 57 and the recording head 39.

The flow channel member 50 is assembled in the carriage body 30 so that the flow channel portion 55 and the tank portion 56 are arranged in the depth direction 103. The flow channel portion 55 is disposed on the guide rail 44 side that is the front side, and the tank portion 56 is disposed on the guide rail 43 side that is the rear side.

As illustrated in FIG. 6, the joint 51 is disposed above the flow channel portion 55. Although not illustrated, the joint 51 has four openings capable of connecting to the respective inlet ports 57 of the flow channel portion 55. The four openings formed in a lower surface of the joint 51 are aligned in line, and the joint 51 is a long member in a direction in which the openings are aligned. The joint 51 is assembled in the flow channel portion 55 in a state where a longitudinal direction thereof is along the first arrangement direction 104. As illustrated in FIG. 7, two pins 65 and 66 projecting upward are provided on the flow channel portion 55. The above pins 65 and 66 are inserted into the joint 51, and thereby the joint 51 is positioned with respect to the flow channel portion 55.

As illustrated in FIG. 6, the connection portions 59 to be connected respectively to the ink tubes 41 are provided on an upper surface side of the joint 51. The connection portions 59 correspond to connection ports. As illustrated in FIG. 8, four connection portions 59 are provided corresponding to the four ink tubes 41. Like the inlet ports 57, the four connection portions 59 are arranged in the first arrangement direction 104. Each of the connection portions 59 has a cylindrical tube shape capable of being inserted into an inner space of each of the ink tubes 41. The connection portions 59 are each disposed so that an axis direction of each of the cylindrical tube shapes is parallel to the extending direction 106. The extending direction 106 is a direction perpendicular to the first arrangement direction 104 and parallel to the virtual plane 105. The extending direction 106 corresponds to a fourth direction.

The ink tubes 41 are connected to the connection portions 59 respectively, allowing the inks to flow into the recording head 39 from the ink tubes 41 through the flow channel portion 55.

Head Control Board 52

The head control board 52 (see FIG. 4) is disposed on an upper side of the tank portion 56 of the flow channel member 50 in the carriage body 30. The head control board 52 is a board that controls operation of the recording head 39 and is electrically connected thereto. The head control board 52 has various electronic elements mounted on a printed circuit board thereof. Descriptions of a circuit configuration of the head control board 52 are omitted here.

The head control board 52 is electrically connected to a control board (not illustrated) of the multifunction apparatus 10 by a FFC (Flexible Flat Cable) 53 (see FIG. 4). The control board controls operation of the multifunction apparatus 10. The head control board 52 outputs an electric signal such as a drive signal in order to control the operation of the recording head 39 based on an electric signal output from the control board.

Tube Retaining Member 70

Figure 5:
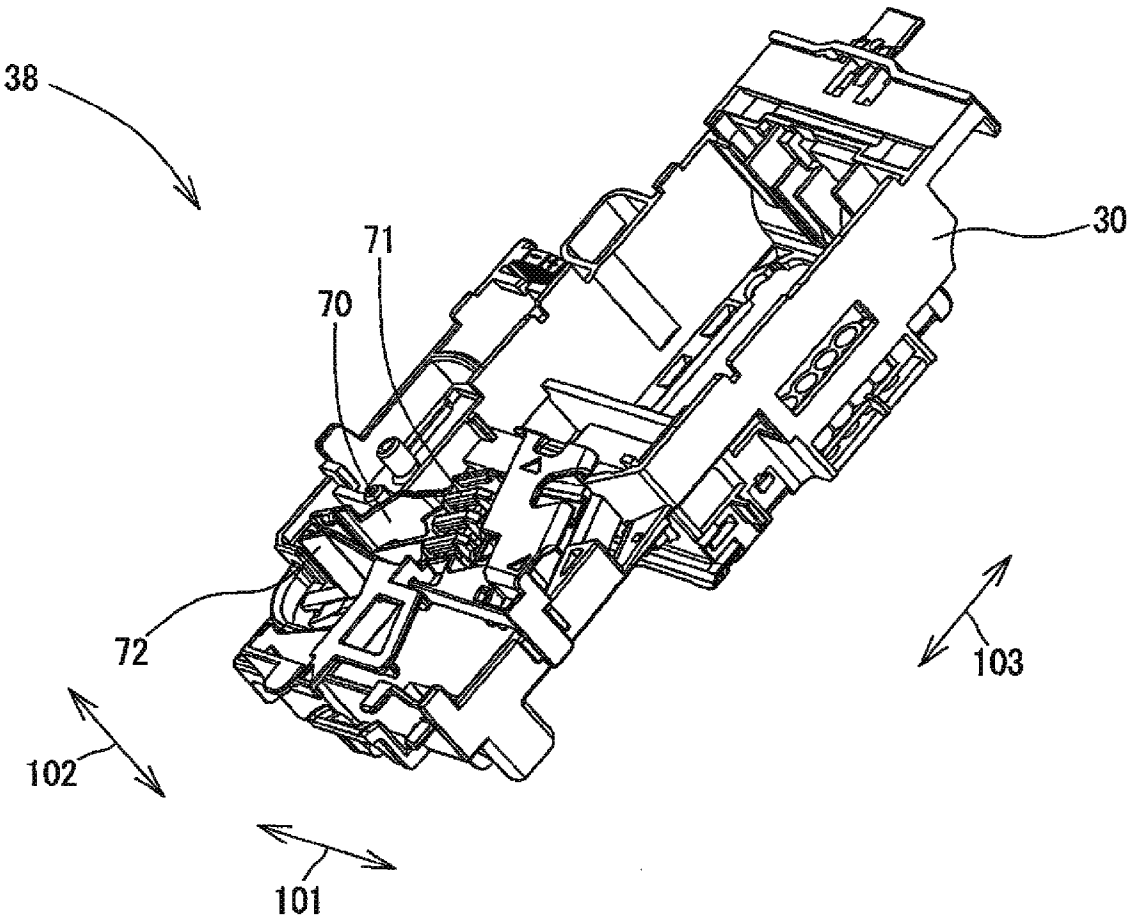
FIG. 5 is a perspective view showing a carriage body to which a tube retaining member is attached.

As illustrated in FIGS. 5, 6, and 8, the tube retaining member 70 is provided on the carriage body 30 at a portion above the flow channel portion 55 of the flow channel member 50 and adjacent to the joint 51. The tube retaining member 70 is disposed such that a first retaining portion 71 to be described later faces the connection portions 59 in the extending direction 106.

The tube retaining member 70 is formed into substantially a triangular shape as viewed from above and has various projections 74 (see FIG. 6) on the triangular shape. The tube retaining member 70 is detachably mounted on the carriage body 30 by the various projections 74. As illustrated in FIG. 6, the tube retaining member 70 is integrally provided with the first retaining portion 71 and a second retaining portion 72. As illustrated in FIG. 8, the first retaining portion 71 is formed at a portion near a side 110 of the triangle opposite to an apex 109 thereof. The second retaining portion 72 is formed at a portion near the apex 109 of the triangle.

As described above, the connection portions 59 are each disposed so that the axis direction of each of the cylindrical tube shapes is parallel to the extending direction 106. Thus, the ink tubes 41 connected respectively to the connection portions 59 extend in the extending direction 106. The first retaining portion 71 faces the connection portions 59 in the extending direction 106 and, therefore, the first retaining portion 71 receives and retains the first portions 41A of the plurality of ink tubes 41 extending in the extending direction 106.

As illustrated in FIGS. 6 and 8, the first retaining portion 71 individually retains the four ink tubes 41 connected respectively to the connection portions 59 such that the four ink tubes 41 are arranged in the first arrangement direction 104. In this embodiment, the first retaining portion 71 has four cutout portions 75 arranged in the first arrangement direction 104. The four cutout portions 75 each have an entrance portion in the height direction 102 having an interval slightly smaller than the outer diameter of the each of the ink tubes 41 and have a bottom portion in the height direction 102 having an interval slightly larger than the outer diameter of the each of the ink tubes 41. Thus, the ink tubes 41 pushed into the respective cutout portions 75 from their entrance portions are retained at their back portions. Further, the cutout portions 75 extend in the extending direction 106. Accordingly, the ink tubes 41 retained in the first retaining portion 71 extend in the extending direction 106. The surface of the bottom portion that is in contact with each ink tube 41 in the height direction 102 is located, in the height direction 102, between the upper two ink tubes 41 retained in the second retaining portion 72 and the lower two ink tubes 41 retained in the second retaining portion 72.

As illustrated in FIGS. 6 and 8, the second retaining portion 72 integrally bundles the second portions 41B of the plurality of ink tubes 41 extending from the first retaining portion 71 along the extending direction 106 such that the ink tubes 41 are arranged in a second arrangement direction 107. As illustrated in FIG. 6, the second arrangement direction 107 is a direction perpendicular to the virtual plane 105, i.e., a direction coinciding with the height direction 102. The second arrangement direction 107 corresponds to a third direction. Although the second arrangement direction 107 is perpendicular to the virtual plane 105 in this embodiment, the second arrangement direction 107 need not be perpendicular to the virtual plane 105 as long as the second arrangement direction 107 intersects with the virtual plane 105. In this case, the second arrangement direction 107 does not coincide with the height direction 102.

As illustrated in FIGS. 6 and 8, in this embodiment, the second retaining portion 72 is constituted by two plate-like members. The two plate-like members face each other in the first arrangement direction 104. Further, the two plate-like members extend in the extending direction 106 (corresponding to the fourth direction) and second arrangement direction 107. A length of each of the two plate-like members in the second arrangement direction 107 is slightly larger than a length of the four ink tubes 41 in a bundled state in the second arrangement direction 107. Projections 73 are formed respectively at both end portions of the two plate-like members in the second arrangement direction 107. An interval between the two plate-like members is slightly smaller at the portion at which the projections 73 are formed and slightly larger at the portion at which the projections 73 are not formed than an outer diameter of each of the ink tubes 41.

With the above configuration, while a restoring force generated by twisting the ink tubes 41 between the first and second retaining portions 71 and 72 is applied between the two plate-like members constituting the second retaining portion 72, the ink tubes 41 pushed between the two plate-like members through the portion at which the projections 73 are retained in the arrangement state in the second arrangement direction 107. Further, the two plate-like members also extend in the extending direction 106, so that the ink tubes 41 retained in the second retaining portion 72 extend in the extending direction 106. The uppermost ink tube 41 in the second retaining portion 72 corresponds to the rearmost ink tube 41 in the first retaining portion 71 (the rearmost ink tube 41 corresponds to an uppermost ink tube 41 in FIG. 8). That is, the ink tubes 41 are disposed sequentially downward in the second retaining portion 72 starting from the rearmost ink tube 41 in the first retaining portion 71 toward the frontmost ink tube 41 therein.

As described above, the ink tubes 41 extending from the cartridge attachment portion 33 and bent at the portion at which the ink tubes 41 are fixed to the clip 36 extend in the width direction 101 and are then connected to the carriage 38. That is, the ink tubes 41 extending along the width direction 101 are turned in the extending direction 106 by being retained by the second retaining portion 72 of the tube retaining member 70. That is, the ink tubes 41 are inserted into the carriage 38 obliquely with respect to the width direction 101.

Thus, the tube retaining member 70 receives the plurality of ink tubes 41 extending from the plurality of connection portions 59 in the extending direction 106 and allows the ink tubes 41 to extend along the width direction 101. In other words, the plurality of ink tubes 14 extending from the plurality of connection portions 59 further extends in a direction away from the tube retaining member 70.

As illustrated in FIG. 8, in this embodiment, a position of the second retaining portion 72 in the first arrangement direction 104 corresponds to a center portion 108 of the plurality of connection portions 59 in the first arrangement direction 104. That is, the second retaining portion 72 of the tube retaining member 70 retains the ink tubes 41 such that the ink tubes 41 are arranged in the second arrangement direction 107 at a position corresponding to the center portion 108 of the plurality of connection portions 59 in the first arrangement direction 104.

The first and second retaining portions 71 and 72 of the tube retaining member 70 preferably extend in parallel to each other as viewed from above, as illustrated in FIG. 8. Although the center portion of the plurality of connection portions 59, the center portion of the plurality of cutout portions 75 in the first arrangement direction 104, and the center portion of the second retaining portion 72 in the first arrangement direction 104 are linearly aligned in the extending direction 106, the positional relationship between the connection portions 59, the cutout portions 75 of the first retaining portion 71, and the second retaining portion 72 are not limited to this. That is, the center portion of the second retaining portion 72 in the first arrangement direction 104 may be linearly aligned with one of the center portions of the cutout portions 75 in the extending direction 106. In this case, the second retaining portion 72 is preferably disposed inside relative to positions facing the cutout portions 75 of the first retaining portion 71 positioned at both ends in the first arrangement direction 104. Further, the extending directions of the cutout portions 75 and second retaining portion 72 need not always be parallel to each other.

Effect of the Embodiment

According to the embodiment described above, the ink tubes 41 are twisted, at the tube retaining member 70, to change their arrangement direction from the second arrangement direction 107 to the first arrangement direction 104. However, the twisted ink tubes 41 are retained in the first retaining portion 71 and second retaining portion 72. This can reduce a load applied to the carriage 38 due to the twisting of the ink tubes 41. In particular, stress generated due to the twisting of the ink tubes 41 can be received by the first retaining portion 71, thereby reducing stress applied to each connection portion 59.

Figure 9A:
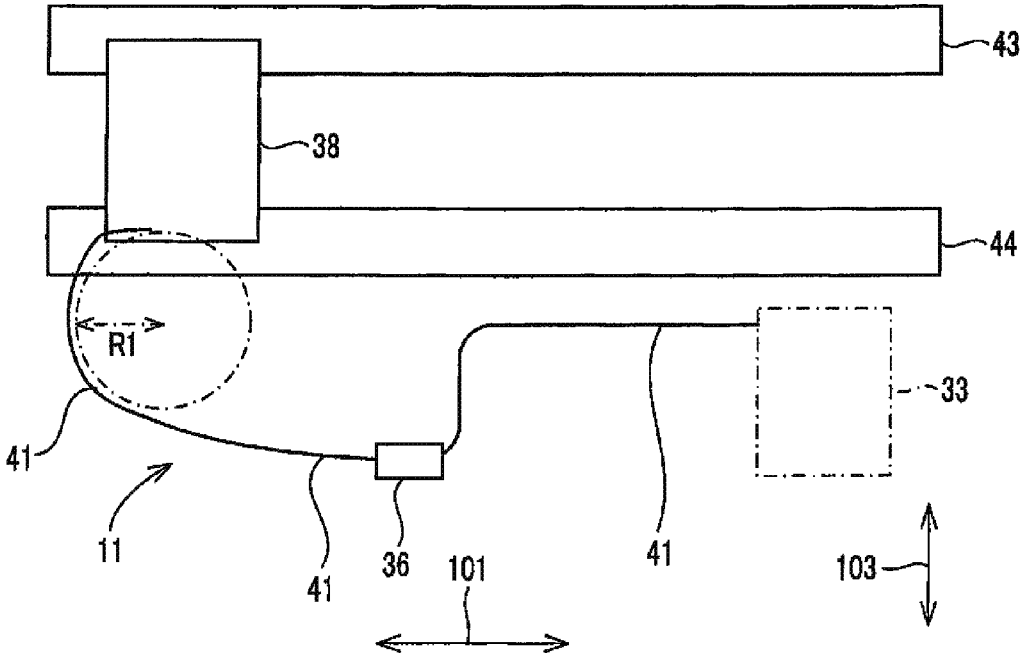
FIG. 9A is a schematic plan view showing an internal configuration of the printer unit according to a conventional configuration of the multifunction apparatus.
Figure 9B:
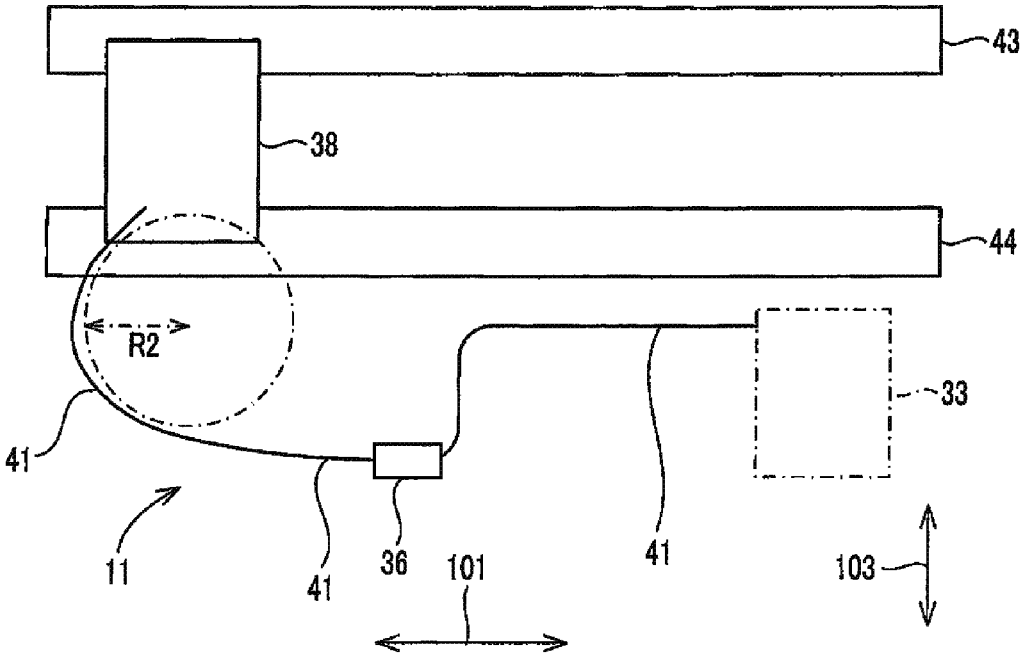
FIG. 9B is a schematic plan view showing an internal configuration of the printer unit according to the embodiment of the present invention.

Further, according to the embodiment described above, the plurality of ink tubes 41 are led out from the carriage 38 in the extending direction 106 which is a direction inclined with respect to the width direction 101. Thus, as illustrated in FIG. 9B, in a state where the carriage 38 is moved to a position far away from the cartridge attachment portion 33 in the width direction 101, a portion of the plurality of ink tubes 41 that extend in the extending direction 106 is included in a curved portion of the ink tubes 41, with the result that a radius of curvature R2 of the ink tubes 41 becomes large. On the other hand, in a conventional configuration in which the plurality of ink tubes 41 are led out from the carriage 38 in the width direction 101, a radius of curvature R1 of the ink tubes 41 becomes smaller than the radius of curvature R2 of the present configuration, as illustrated in FIG. 9A. When the radius of curvature of the ink tubes 41 is increased as in the embodiment described above, a load generated due to the curve of the ink tubes 41 and applied to the carriage 38 can be reduced.

Further, according to the embodiment described above, the surface of the bottom portion that is in contact with each ink tube 41 in the height direction 102 is located, in the second arrangement direction 107, between the upper two ink tubes 41 retained in the second retaining portion 72 and the lower two ink tubes 41 retained in the second retaining portion 72. Hence, in a case where the plurality of ink tubes 41 arranged in the second arrangement direction 107 are twisted in the first arrangement direction 104, loads generated at two of the ink tubes 41 that are positioned at both end portions in the second arrangement direction 107 can be made substantially equal.

Further, according to the embodiment described above, the plurality of ink tubes 41 are twisted to change their arrangement direction from the second arrangement direction 107 to the first arrangement direction 104 at a position corresponding to the center portion 108 of the plurality of connection portions 59 in the first arrangement direction 104. As a result, loads generated at two of the ink tubes 41 that are positioned at both ends in the arrangement direction due to the twisting of the ink tubes 41 can be made equal.

Further, according to the embodiment described above, the second arrangement direction 107 and virtual plane 105 are perpendicular to each other. The loads generated at the ink tubes 41 can be reduced in comparison with the loads generated at the ink tubes 41 that an arrangement direction of the ink tubes 41 is inclined with the virtual plane 105.

What is claimed is:

1. An ink supply device comprising:

a storage portion configured to store ink;

a carriage configured to be moved in a first direction;

a recording head mounted on the carriage and including nozzles that allow ink droplets to be ejected;

a flow channel member mounted on the carriage and including a plurality of connection ports arranged in a second direction, the first direction and the second direction lying in an imaginary plane which is parallel to a recording sheet, the flow channel member including a flow channel that allows the ink to flow from the plurality of connection ports to the recording head;

a plurality of tubes each corresponding to each of the plurality of connection ports and each having one end and the other end, the one end being connected to the storage portion, the other end being connected to the corresponding connection port, the ink being configured to be supplied from the storage portion to the flow channel member through the plurality of tubes, each of the plurality of tubes having a first portion adjacent to the other end and a second portion adjacent to the first portion, the first portion being positioned between the other end and the second portion; and a tube retaining member provided on the carriage and including a first retaining portion configured to retain the first portions to be arranged in the second direction, and a second retaining portion configured to retain the second portions to be arranged in a third direction intersecting with the imaginary plane.

2. The ink supply device according to claim 1, wherein the first direction intersects with the second direction, wherein the tube retaining member is configured to support the plurality of tubes extending from the flow channel member in a fourth direction perpendicular to the second direction and parallel to the imaginary plane, and wherein a portion of each tube that extends from the tube retaining member extends with respect to the first direction away from the tube retaining member and the storage portion, and is bent so as to make a U-turn toward the storage portion if the carriage is located at a position closest to the storage portion, the plurality of tubes being configured to be bent following a movement of the carriage to change postures of the plurality of tubes.

3. The ink supply device according to claim 1, wherein a center portion of the plurality of connection ports in the second direction is linearly aligned with the second retaining portion in a fourth direction perpendicular to the second direction.

4. The ink supply device according to claim 3, wherein each of the plurality of tubes has a same shape.

5. The ink supply device according to claim 3, wherein the third direction is perpendicular to the imaginary plane.

6. The ink supply device according to claim 1, wherein the tube retaining member is configured to be detachably mounted on the carriage.

7. The ink supply device according to claim 6, wherein the tube retaining member is integrally provided with the first retaining portion and the second retaining portion.

8. The ink supply device according to claim 1, wherein the recording head mounted on the carriage and the storage portion are arranged in a fifth direction perpendicular to the first direction and parallel to the imaginary plane if the carriage is located at a position closest to the storage portion, and wherein a whole of the plurality of tubes is located on a storage portion side with respect to one of the plurality of connection ports in the fifth direction, the one of the plurality of connection ports being located at a position closest to the recording head.

* * * * *